United States Patent [19]

Jones

[11] 4,104,607

[45] Aug. 1, 1978

[54] ZERO TEMPERATURE COEFFICIENT OF RESISTANCE BI-FILM RESISTOR

[75] Inventor: William Kinzy Jones, Cambridge, Mass.

[73] Assignee: The United States of America as represented by the Secretary of the Navy, Washington, D.C.

[21] Appl. No.: 777,225

[22] Filed: Mar. 14, 1977

[51] Int. Cl.[2] ..... H01C 1/012

[52] U.S. Cl. ..... 338/309; 29/620; 29/621; 338/9; 338/314; 427/103; 427/126

[58] Field of Search ..... 338/9, 308, 309, 307, 338/314; 427/103, 123, 124, 126; 29/610, 620, 621; 252/518

[56] References Cited

U.S. PATENT DOCUMENTS

| | | | |
|---|---|---|---|
| 3,393,390 | 7/1968 | Louis | 338/9 |
| 3,591,413 | 7/1971 | Seki et al. | 338/308 |
| 3,602,861 | 8/1971 | Tweed | 338/9 |
| 4,019,168 | 4/1977 | Collins | 338/309 |
| 4,025,404 | 5/1977 | Joly et al. | 338/309 |

*Primary Examiner*—C. L. Albritton

*Attorney, Agent, or Firm*—Richard S. Sciascia; Paul N. Critchlow

[57] ABSTRACT

A first thin-film resistor member, preferably TaN, is disposed over a second thin film member, such as NiCr, to completely cover the second member and act as a passivating layer preventing anodization of the second. The thin-film materials used for the first and second members have substantially an equal thin-film, sheet-resistance, resistance value per square (Ω□), with the first material being trimmable for this purpose. Also, the TCR (temperature coefficient of expansion) of the first material is negative while that of the second is positive. These members are coupled in parallel with substantially equal lengths but with differing widths which permit the first to completely cover the second. The arrangement permits the TCR of the parallel circuit to be brought substantially to a zero value and, in any event, a value no greater than ± 50 ppm/° C. Additionally, the first member anodically protects the second with the protection being assured by the formation of an oxide film formed on the first by the trimming. The bi-film system is adapted for microcircuitry in that it provides an acceptable sheet resistance without requiring excessive lengths or widths of the parallel circuit members.

9 Claims, 3 Drawing Figures

ZERO TEMPERATURE COEFFICIENT OF RESISTANCE BI-FILM RESISTOR

BACKGROUND OF THE INVENTION

The present invention relates to thin-film resistor systems of the type having a low temperature coefficient of resistance and, more particularly, to systems adapted for microcircuitry applications.

As already indicated, the term 'TCR' presently is employed to connote the well-known change in the resistance value of a resistor material which accompanies unit changes in temperature. There, of course, have been numerous attempts to provide low TCR resistors and the variety of thin-film materials and combinations of materials have been suggested. For example, systems utilizing thin-film cermet films or a combination of a cermet film and a conductive plastic with positive and negative TCR have been proposed. Without comment on the effectiveness of these or other suggestions, a common difficulty of these prior systems is that, in order to achieve the low TCR capability, very special process controls must be applied during their fabrication. In other words, their processing must be performed carefully and with considerable precision if the desired results are to be achieved and, of course, any failure in this regard tends to degrade the reliability and effectiveness of the end product. Of perhaps greater importance, the extensive processing requirements do not permit mass production techniques which, of course, are highly desirable if the products are to be made available at a reasonable cost. A further related difficulty is that the suggested resistor materials either are not readily available or, in the form in which they are available, must be altered considerably before use.

Therefore, one of the principal objects of the present invention is to provide a thin-film, low TCR, bi-film resistor system in which the material used for the bi-film resistors are commercially available resistor materials having nominal properties which, when combined, can provide a system having a TCR no greater than ± 50 ppm/° C.

Another object is to provide a thin-film resistor system capable of providing a zero TCR with minimal process controls of the materials used in the system.

Yet another object is to provide a low TCR system that is suitable, both in size and in its electrical properties, for use in microcircuitry applications.

A more specific object is to provide a bi-film resistor system for microcircuitry applications utilizing a combination of a tantalum-based system having a negative TCR with a nickel chromium film having a positive TCR.

Still another important object is to provide a low TCR system which uses the NiCr but in which the NiCr is fully protected against anodic attack.

Other objects and their attendant advantages will become more apparent in the ensuing detailed description.

BRIEF DESCRIPTION OF THE DRAWINGS

The present invention is illustrated in the accompanying drawings of which.

DETAILED DESCRIPTION OF THE INVENTION

Figure 1:
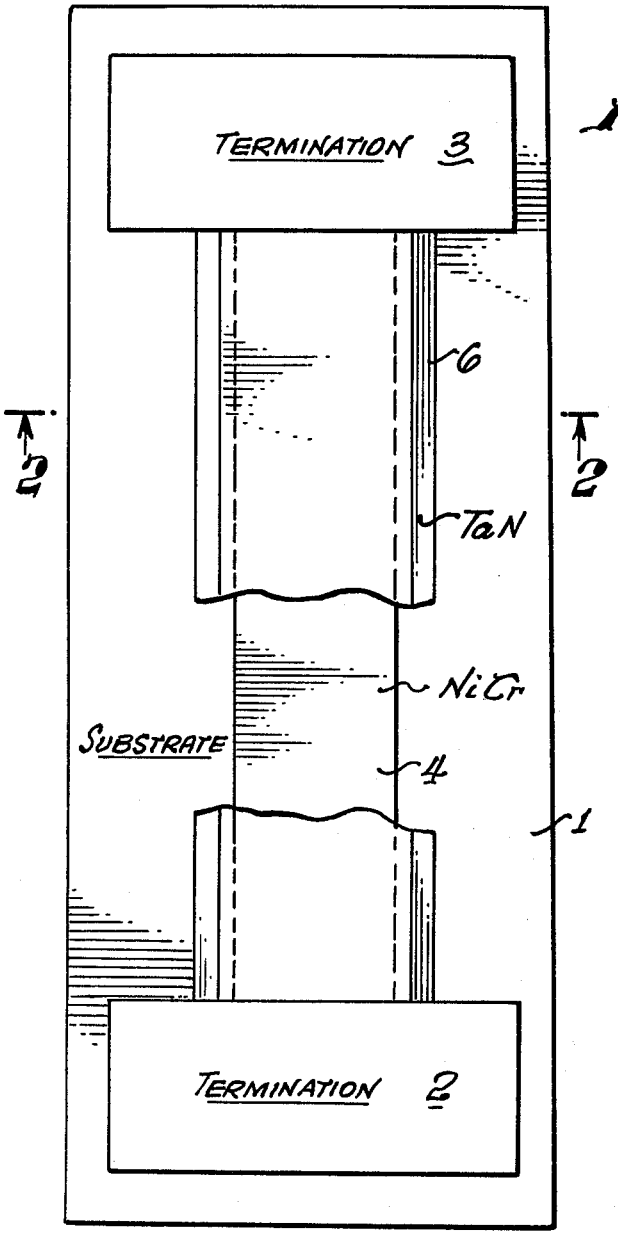
FIG. 1 is a somewhat diagrammatic plan view of the bi-film system.

Referring to FIG. 1, the present system includes a conventional substrate member 1 formed of a ceramic material or the like, such as alumina. Mounted on the substrate are end terminal means 2 and 3 in the form of thin conductive films deposited in well-known manners to couple the resistor circuit to external components which, as indicated, may be components of a microcircuit. The parallel resistor circuit itself is, as shown, a bi-film arrangement including, preferably, a NiCr film 4 adhered directly and intimately to the substrate and a tantalum-based film 6 overlying film 4 in intimate electrical contact with it. The procedures for applying the bi-film members to the substrate are well-known and should need no special explanation.

As has been noted, the resistor materials used in the circuit preferably are TaN and NiCr although materials, such as TaAlN also can be used. Before considering the manner in which these materials are used, it may be helpful to consider the materials themselves and some of their properties. For example, both of these materials are readily available and, in the form in which they are commercially available, their nominal properties are suitable for use in the present system without the need for the special process controls applicable to many prior art proposals. Also, as will be recognized, these materials exemplify the major thin-film resistors in use today. Even so, it also is a fact that each of these resistor materials, if used individually, exhibits certain disadvantages one of which is that neither material individually is capable of achieving the low TCR desired for the present system. As has been stated, the present system is characterized by a TCR ranging from a theoretical zero to a value no more than ± 50 ppm/° C. For example, the TaN has a nominal negative TCR of −60 ppm/° C while the NiCr has a positive TCR of about 100.

Another difficulty insofar as the use of these materials is concerned is that the NiCr is quite reactive in that it is subject to anodic attack and must be passivated if effectiveness and stability is to be maintained. Thus, one of the features of the present invention lies in combining these particular materials in a manner which not only achieves the low TCR but also in combination exhibits properties superior to either of the individual materials and, in addition, provides the necessary passivation of the NiCr.

Physically considered, the two resistor systems are disposed on the substrate with the TaN film completely covering the NiCr so as to provide a protective passivation layer for the NiCr. For the purpose of zero TCR, the TaN layer or film, which can be called '$R_1$', obviously must be wider than the NiCr or '$R_2$' film. For example, in a zero TCR illustration to be described, the relationship is one in which the width of $R_2$ equals 0.6 that of $R_1$. The electrical as well as physical lengths, however, of $R_1$ and $R_2$ are equal, both terminating at spaced end terminals 2 and 3. A further constraint of particular importance is that the unit resistance value of the material used for $R_1$ and $R_2$ must be closely matched or, in other words, substantially equal. For present purposes this resistance value is expressed by the conventionally used term of ohms/square (Ω□) which, as is known, is the ohmic value for a unit square of the material or a square area having a unit length and width. In this regard, TaN is a trimmable resistor which easily can be trimmed by anodization or by thermal methods to produce the desired electrical properties. Also of considerable significance is the fact that the trimming of the TaN inherently passivates it by producing a $Ta_2O_5$ layer. Consequently, the use of a trimmed TaN resistor over the reactive NiCr film assures a passivation layer for the NiCr. The use of the TaN layer provides a trimmable resistor which protects the underlying NiCr and also achieves the zero TCR capability.

Figure 3:
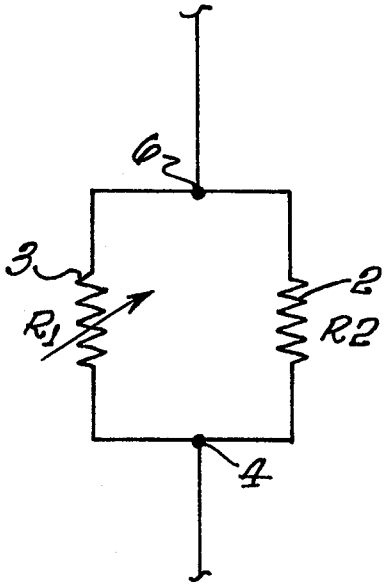
FIG. 3 is an electrical diagram illustrating the functioning of the parallel circuit formed by the bi-film materials.
Figure 2:
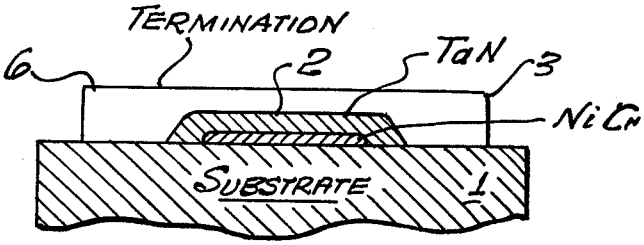
FIG. 2 is a section taken along line 2—2 of FIG. 1.

The electrical concept of the system is illustrated in FIG. 3 which should be self-explanatory. It will be noted that the $R_1$ leg is identified as having a variable resistance achieved by the trimmable property of this leg. To provide the low-to-zero TCR capability it first is necessary to employ resistor materials that have matched Ω/□ values as well as positive and negative TCR values which, when added algebraically, provide the desired result. In these regards, the TaN and NiCr appear to be most advantageous since they are readily available and, as available, their Ω/□ can provide a close match and their TCR values also compliment one another. Thus, TaN or TaAl-N having as its nominal properties a TCR of −60 ppm/° C and an Ω/□ of 125 can be used as the $R_1$ leg with trimming by anodization or thermal processes. Its complimentary bi-film material, in turn, is NiCr again with nominal properties of +100 ppm/° C and a matching Ω/□ of 125. No trimming of the $R_2$ leg is required. By combining these two materials in a parallel resistor in which $R_1 = 0.6\ R_2$, it will be recognized that, since the Ω/□ are equal, the width of the NiCr ($R_2$) then becomes 0.6 that of TaN ($R_1$). Using these values for the equal length resistors, the following properties obtain:

$$TCR_{\parallel} = \left(\frac{R_2}{R_1 + R_2}\right) TCR_1 + \left(\frac{R_1}{R_1 + R_2}\right) TCR_2 \qquad \text{Equation (1)}$$

The term $TCR_{//}$ signifies the TCR of the parallel circuit illustrated in FIG. 3. By substituting the value of $R_1 = 0.6\ R_2$ and the TCR values of $R_1$ and $R_2$:

$$TCR_{\parallel} = \left(\frac{R_2}{1.6\ R_2}\right)(-60\ \text{ppm/° C}) + \left(\frac{.6\ R_2}{1.6\ R_2}\right)(+100\ \text{ppm/° C}) \qquad \text{Equation (1)}$$

$$= (.6250)(-60) + (.375)(+100)$$

$$= 0\ \text{ppm/° C}$$

Another factor affecting performance is the resistance of the parallel circuit or, in other words, its sheet resistivity. In this regard it will be recognized that the thin-film resistors used in the system have some physical constraints if, as is contemplated, they are to be used for microcircuitry. Any practical design is constrained or limited particularly by the length of the resistor which obviously cannot be excessive but which also, at its limited length, has an adequate resistance range. As seen in the following analysis, the 0 ppm/° C $TCR_{//}$ achieved for the conditions described above will have a sheet resistivity of about 80 Ω/□ which is acceptable within the practical design limits imposed by microcircuitry. Thus, using the conventional equation of $R_{//} = (R_1 \cdot R_2)/(R_1 + R_2)$ and converting the terms to Ω/□:

$$(\Omega/\square)_{\parallel} \cdot \square_{\parallel} = \frac{[(\Omega/\square_1)(\square_1)]\ [(\Omega/\square_2)(\square_2)]}{(\Omega/\square_1)\ \square_1 + (\Omega/\square_2)\ \square_2}$$

since $\square_{//} = \square_1$; $\square_1 = 0.6\square_2$ and $\Omega/\square_1 = \Omega\square_2$ $\Omega/\square_{//} - 0.625\ \Omega/\square_1 = 80\ \Omega/\square$ The foregoing development of a 0 ppm/° C utilized the nominal properties of the TaN and NiCr and it also utilizes an $R_1$ to $R_2$ relationship which is derived from the TCR relationship. However, it should be noted that the invention is not intended to be limited to the zero TCR capability. Instead, the primary concern is to provide a low TCR system which is characterized by a TCR value of no more than ± 50 ppm/° C and to provide it in a manner that requires minimum process controls. As far as is known, such a system is not presently available.

To achieve its purposes, certain criteria already discussed must be recognized. First, the Ω/□ must be closely matched. Also the lengths of $R_1$ and $R_2$ should be substantially equal. However, the widths of these members can vary, since the $R_1$ leg must be wider or equal to $R_2$ and, due to the equal lengths, the widths will determine the $R_1$ to $R_2$ relationship. As is apparent in Equation (1), the width is to some extend related to the TCRs of the selected materials and they also will affect the sheet resistivity of the circuit.

The particular advantages of the present invention are for the most part apparent in the above discussion. First, it is capable of providing a zero TCR with very limited process control. Also, the system is self-passivating and its properties, such as stability etc. are better than those of its individual components. Further, its resistance value is trimmable and the system is not subject to known catastrophic failure modes such as occur with NiCr. In particular, it provides a commercial resistor easily adapted for mass production at reasonable costs and especially suited for microcircuitry. At present, the discrete Julie resistor is the only commercially-available low TCR resistor. Other known commercial resistors have a TCR value greater than ± 50 ppm/° C. However, because of its size requirements the Julie resistor is not suitable for hybrid microcircuit applications.

Obviously, many modifications and variations of the present invention are possible in the light of the above teachings. It is therefore to be understood that within the scope of the appended claims the invention may be practiced otherwise than as specifically described.

I claim:

1. A bi-film resistor system having a parallel temperature coefficient of resistance (TCR) less than ±50 ppm/° C comprising:

a substrate, and a parallel resistor circuit mounted on said substrate, said circuit including:

elongate coaxially-disposed first and second thin-film resistor members formed of selected materials having substantially equal resistance values per square (Ω/□) with said first member overlying said second and being formed of a material that is anodically non-reactive and has a negative TCR, said second being anodically reactive and having a positive TCR, and conductive terminal members coupled to each end of each member, said thin film members being of substantially equal electrical length with first member being of sufficient width for blanketing said second and providing anodic passivation protection for it; said materials having positive and negative TCRs of such values that, when included in said parallel circuit algebraically, add to provide said parallel TCR of less than ±50 ppm/C°.

2. The system of claim 1 wherein said parallel resistor circuit is adapted for use in microcircuit applications, said parallel circuit having a sheet resistance no greater than about 80 Ω/□.

3. The system of claim 1 wherein said first member is a trimmable resistor material provided with an oxidized anodically non-reactive outer surface layer formed by said trimming.

4. The system of claim 1 wherein said first member is formed of a material selected from a tantalum-based system including Ta-N and TaAl-N.

5. The system of claim 1 wherein said first members is formed of Ta-N having a TCR value of about −60 ppm/° C.

6. The system of claim 5 wherein said second member is formed of a NiCr having a nominal unprocessed TCR value of about 100 ppm/° C.

7. The system of claim 1 wherein said first and second member materials have a nominal unprocessed Ω/□ value of about 125 Ω/□.

8. The system of claim 7 wherein the width ratio of the widths of said first to said second members is about 0.6.

9. The system of claim 8 wherein said Ω/□ value of said parallel resistor circuit is about 80 Ω/□ and the parallel TCR value is about 0 ppm/° C.

* * * * *